US008222547B2

(12) United States Patent
Chapman

(10) Patent No.: US 8,222,547 B2
(45) Date of Patent: Jul. 17, 2012

(54) ELECTRICAL SWITCHING DEVICE BETWEEN PAIRS OF BUSBARS

(75) Inventor: Lawrence J. Chapman, Earlville, IA (US)

(73) Assignee: Illinois Tool Works Inc., Glenview, IL (US)

( * ) Notice: Subject to any disclaimer, the term of this patent is extended or adjusted under 35 U.S.C. 154(b) by 258 days.

(21) Appl. No.: 12/775,616

(22) Filed: May 7, 2010

(65) Prior Publication Data

US 2010/0326801 A1 Dec. 30, 2010

Related U.S. Application Data

(60) Provisional application No. 61/220,873, filed on Jun. 26, 2009.

(51) Int. Cl.
*H01H 13/00* (2006.01)

(52) U.S. Cl. ..... 200/16 A; 200/243

(58) Field of Classification Search ..... 200/16 A, 200/243; 335/131, 88, 159, 11
See application file for complete search history.

(56) References Cited

U.S. PATENT DOCUMENTS 4,950,846 A * 8/1990 Pollard ..... 200/16 A

* cited by examiner

*Primary Examiner* — Vanessa Girardi
(74) *Attorney, Agent, or Firm* — Mark W. Croll; Paul F. Donovan

(57) ABSTRACT

An electrical switch assembly includes a first pair of busbars, each busbar having a first portion and a second portion, the first portion disposed at an angle with respect to the second portion, and a wedge-shaped assembly configured to be repositionable to form an electrical circuit between the first pair of busbars. Also described herein is a non-destructive testing system including the electrical switch assembly.

19 Claims, 6 Drawing Sheets

ELECTRICAL SWITCHING DEVICE BETWEEN PAIRS OF BUSBARS

CROSS REFERENCE TO RELATED APPLICATION

This Non-Provisional Application claims benefit to U.S. Provisional Application Ser. No. 61/220,873 filed on Jun. 26, 2009, the complete subject matter of which is expressly incorporated herein in its entirety.

BACKGROUND OF THE INVENTION

The present invention relates generally to non-destructive testing systems, and more particularly, to an electrical switching device that may be utilized with a non-destructive testing system.

Conventional non-destructive testing systems are commonly used to detect flaws in various objects being inspected. For example, one such non-destructive testing system utilizes magnetic particles to detect flaws in a object fabricated using a ferromagnetic material. During operation, the object is magnetized and then suspended into a bath that includes the magnetic particles. Any discontinuities or inhomogeneities in the object, which lie substantially transverse to the direction of the magnetic field applied to the object, cause the occurrence of localized leakage fields. The localized leakage fields capture some of the magnetic particles. The particles held by the leakage fields form patterns which reveal the existence and locations of the discontinuities and/or inhomogeneities.

To apply the magnetic field to the object, the system utilizes a combination of coils that transmit a relatively high amperage low voltage current through the object being tested. To apply the current to the object, the object is coupled to a contact through a network of busbars and cables. A conventional electrical switching device is then operated to enable the current to be transmitted from a power source through the object and thus form the magnetic field around the object. However, the conventional switching device utilizes a pair of flat bar contacts to transmit the power from the power source to the object. The flat bar contacts have a relatively small surface area. Thus the portion of the flat bar that physically contacts the busbar is also relatively small. Accordingly, the conventional flat bar contacts may experience overheating and/or burning that reduces the operational effectiveness of the conventional switching device.

BRIEF DESCRIPTION OF THE INVENTION

In one embodiment, an electrical switch assembly is provided. The electrical switch assembly includes a first pair of busbars, each busbar having a first portion and a second portion, the first portion disposed at an angle with respect to the second portion, and a wedge-shaped assembly configured to be repositionable to form an electrical circuit between the first pair of busbars.

Also described herein is a non-destructive testing system including the electrical switch assembly.

Other features and advantages of the invention will become apparent to those skilled in the art upon review of the following detailed description, claims and drawings in which like numerals are used to designate like features.

Figure 1:
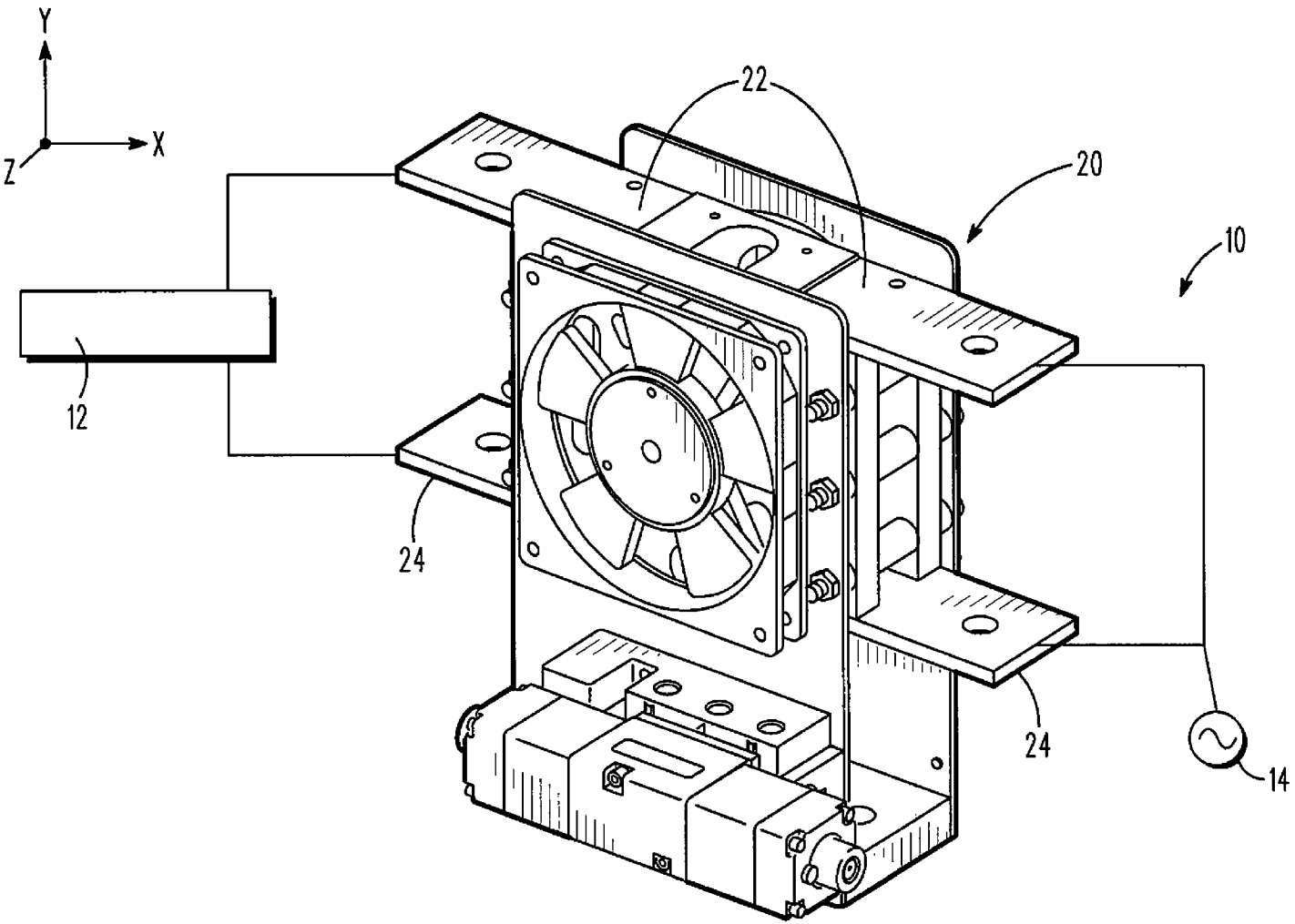
FIG. 1 is a perspective view of an exemplary non-destructive testing system in accordance with an embodiment of the present invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF THE INVENTION

FIG. 1 is a simplified illustration of an exemplary non-destructive testing system 10 that may be used to identify cracks, flaws and/or other defects in an exemplary object 12 being tested. The testing system 10 includes a power source 14 and an exemplary electrical switch assembly 20. The switch assembly 20 includes a first pair of busbars 22 and a second pair of busbars 24. The first and second pairs of busbars 22 and 24 are electrical conductors that are used to form an electrical connection between the power source 14 and the object 12 being tested. In one mode of operation, the switch assembly 20 is configured to transmit power from the power source 14 to the object 12 via the first pair of busbars 22. In the first mode of operation, a first magnetic field is formed around the object 12. In the exemplary embodiment, the first magnetic field is oriented with respect to an X-axis. In a second mode of operation, the switch assembly 20 is configured to transmit power from the power source 14 to the object 12 via the second pair of busbars 24. In the second mode of operation, a second magnetic field is formed around the object 12. In the exemplary embodiment, the second magnetic field is oriented with respect to a Y-axis. More specifically, the second magnetic field is perpendicular or normal to the first magnetic field.

To identify various flaws or defects in the object 12, the object is initially secured to a testing fixture (not shown). The object 12 is then wetted with a bath (not shown) that includes a plurality of magnetic particles (not shown). The object 12 is then magnetized by, for example, positioning the switch assembly 20 in the first operational position. More specifically, the system 10 utilizes a combination of coils (not shown) that transmit a relatively high amperage low voltage current through the object 12 being tested. Any discontinuities or inhomogeneities in the object 12, which lie substantially transverse to the direction of the magnetic field applied to the object 12, cause the occurrence of localized leakage fields. The localized leakage fields capture some of the magnetic particles. The magnetic particles held by the leakage fields form patterns which reveal the existence and locations of the discontinuities and/or inhomogeneities. In the first mode of operation, the magnetic field is oriented along the horizontal or X-axis of the object 12. Thus, any discontinuities or inhomogeneities in the object 12, which lie substantially transverse to the X-axis may be identified.

In the second mode of operation, the object 12 is again magnetized by, for example, positioning the switch assembly 20 in the second operational position. Any discontinuities or inhomogeneities in the object 12, which lie substantially transverse to the direction of the magnetic field applied to the object 12, cause the occurrence of localized leakage fields. In the second mode of operation, the magnetic field is oriented along the horizontal or Y-axis of the object 12. Thus, any discontinuities or inhomogeneities in the object 12, which lie substantially transverse to the Y-axis may be identified. In the exemplary embodiment, the switch assembly 20 enables the object 12 to be subjected to both the first and second magnetic fields without decoupling the object 12 from the text fixture, thus reducing the overall time to test the object 12.

Figure 2:
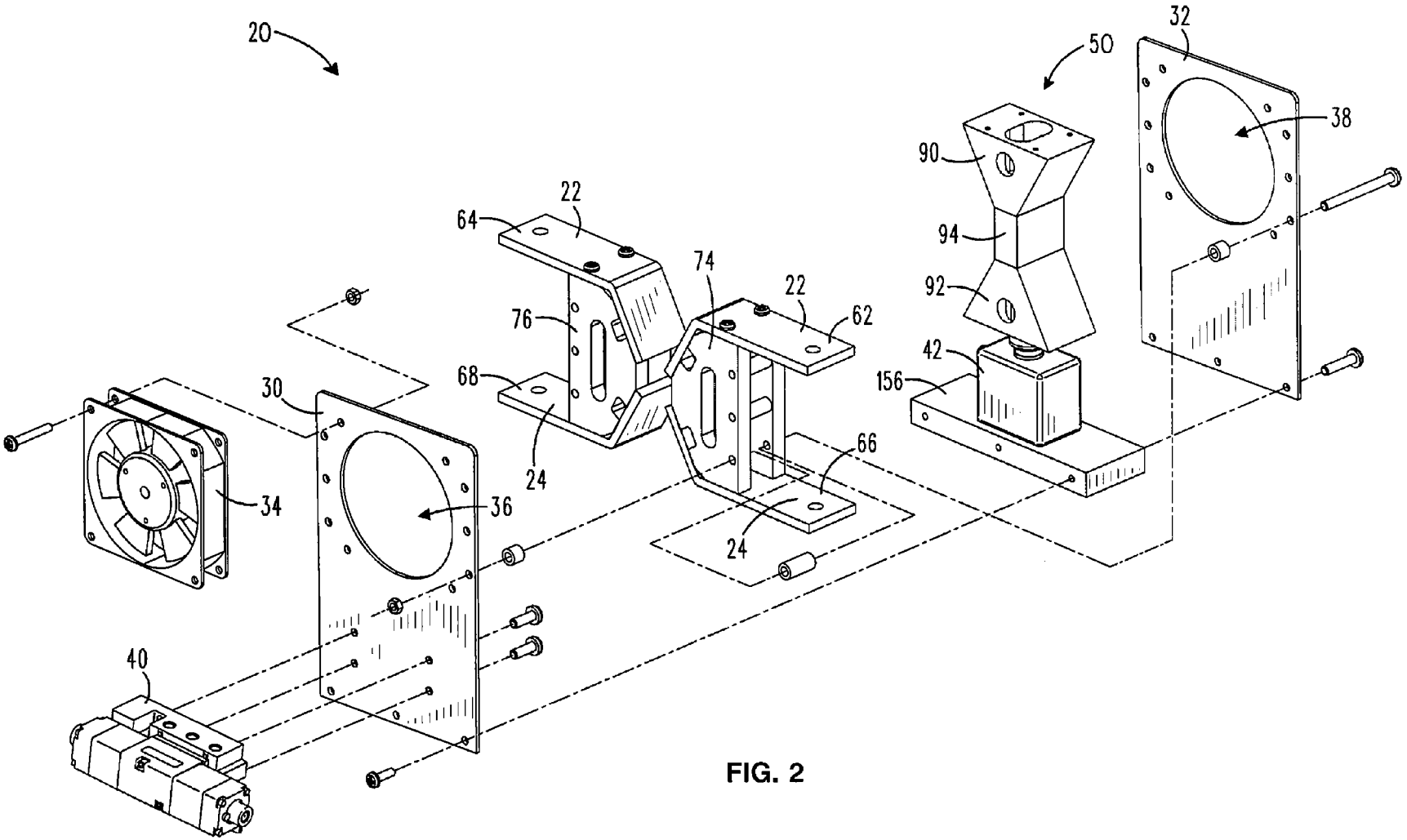
FIG. 2 is an exploded view of an exemplary switch assembly that may be used with the system shown in FIG. 1 in accordance with an embodiment of the present invention.
Figure 3:
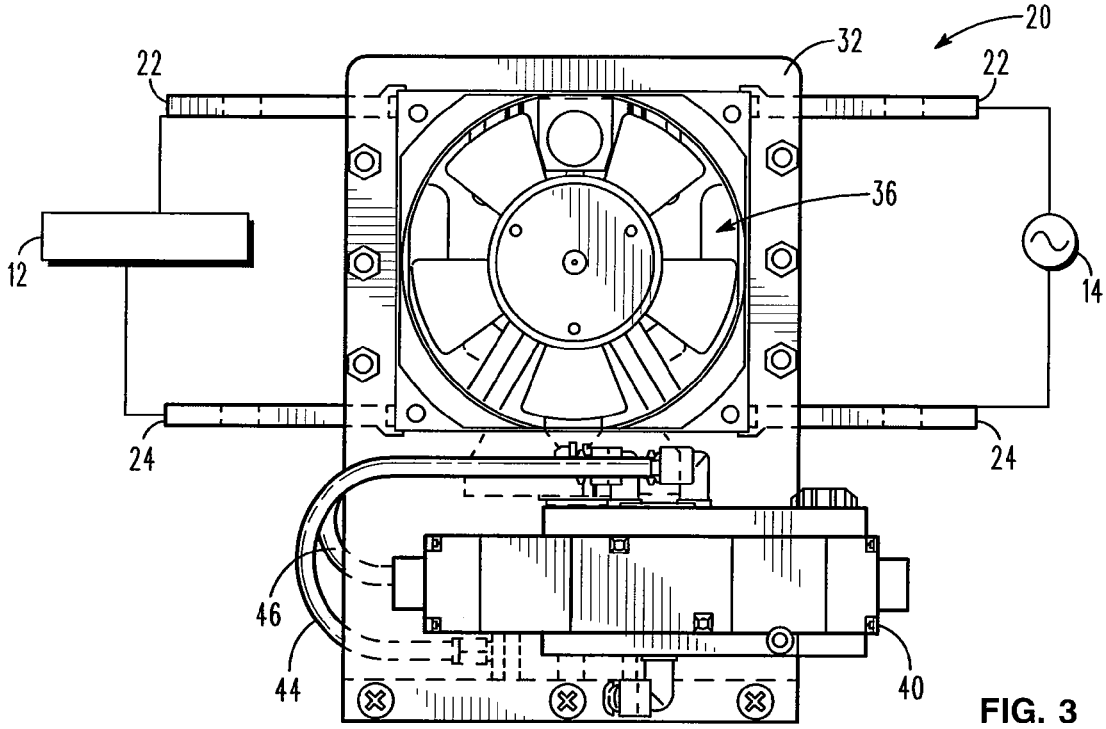
FIG. 3 is a front view of the switch assembly shown in FIG. 2.
Figure 4:
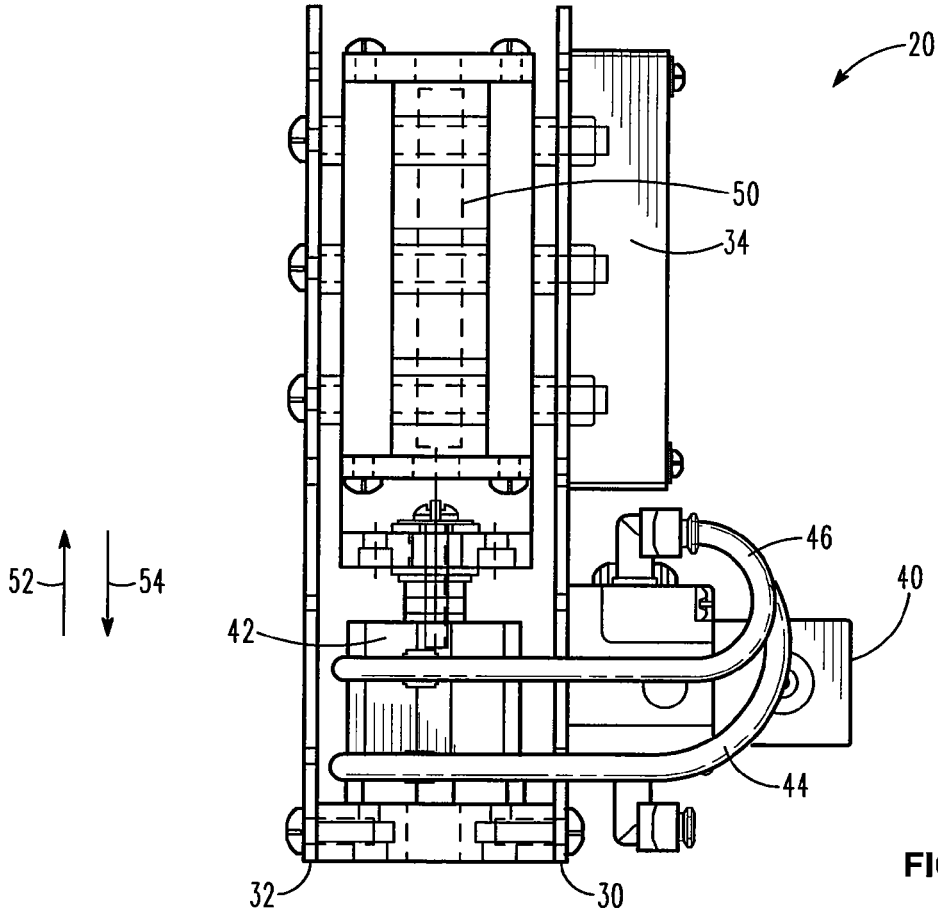
FIG. 4 is a side view of the switch assembly shown in FIG. 2.

FIG. 2 is an exploded view of the switch assembly 20 shown in FIG. 1. FIG. 3 is a front view of the switch assembly 20 shown in FIG. 2. FIG. 4 is a side view of the switch assembly 20 shown in FIG. 2. The switch assembly 20 includes the first pair of busbars 22 and the second pair of busbars 24. The first and second pairs of busbars 22 and 24 are electrical conductors that are used to form an electrical connection between the power source 14 and the object 12 being tested. In one mode of operation, the switch assembly 20 is configured to transmit power from the power source 14 to the object 12 via the first pair of busbars 22. In another mode of operation, the switch assembly 20 is configured to transmit power from the power source 14 to the object 12 via the second pair of busbars 24.

The switch assembly 20 also includes a front plate 30 and a rear plate 32. The front and rear plates 30 and 32 form the mounting structure that is utilized to mount the various components of the switch assembly 20. For example, as shown in FIG. 2, the first and second pairs of busbars 22 and 24 are stationarily mounted between and to the front and rear plates 30 and 32. The switch assembly 20 further includes a fan assembly 34 that is mounted to the front plate 30. During operation, the fan assembly 34 is configured to generate cooling air that is utilized to cool the various components of the switch assembly 20. As shown in FIG. 2, in the exemplary embodiment, the front plate 30 has an opening 36 extending therethrough. The fan assembly 34 is mounted in front of the opening 36 such that cooling air is transmitted from the fan assembly 34 through the opening 36 to provide cooling air to the components mounted between the front and rear plates 30 and 32. To enable the cooling air to be discharged from the switch assembly 20, the rear plate 32 also includes an opening 38 extending therethrough. As shown in FIG. 2, the opening 38 is substantially aligned with the opening 36 such that the cooling air generated by the fan assembly 34 travels in a substantially linear path from the fan assembly 34, through the opening 36 and exits through the opening 38.

Referring again to FIGS. 2 and 4, the switch assembly 20 also includes a solenoid actuator 40 that is coupled to a piston device 42. In the exemplary embodiment, the solenoid actuator 40 is a two-position solenoid that is configured to receive an electrical input. In response to the electrical input, the solenoid actuator 40 transmits an air signal to the piston device 42 via either a first air supply tube 44 or a second air supply tube 46. For example, in one mode of operation, the solenoid actuator 40 may transmit an air signal to the piston device 42 via the first air supply tube 44. In this case, the piston device 42 is configured to reposition a wedge assembly 50 in a first direction 52. In the second mode of operation, the solenoid actuator 40 may transmit an air signal to the piston device 42 via the second air supply tube 46. In this case, the piston device 42 is configured to reposition the wedge assembly 50 in an opposite direction 54. The wedge assembly 50 is configured to form an electrical connection between either the first pair of busbars 22 or the second pair of busbars 24. The detailed description and operation of the wedge assembly 50 is discussed in more detail below.

Figure 5:
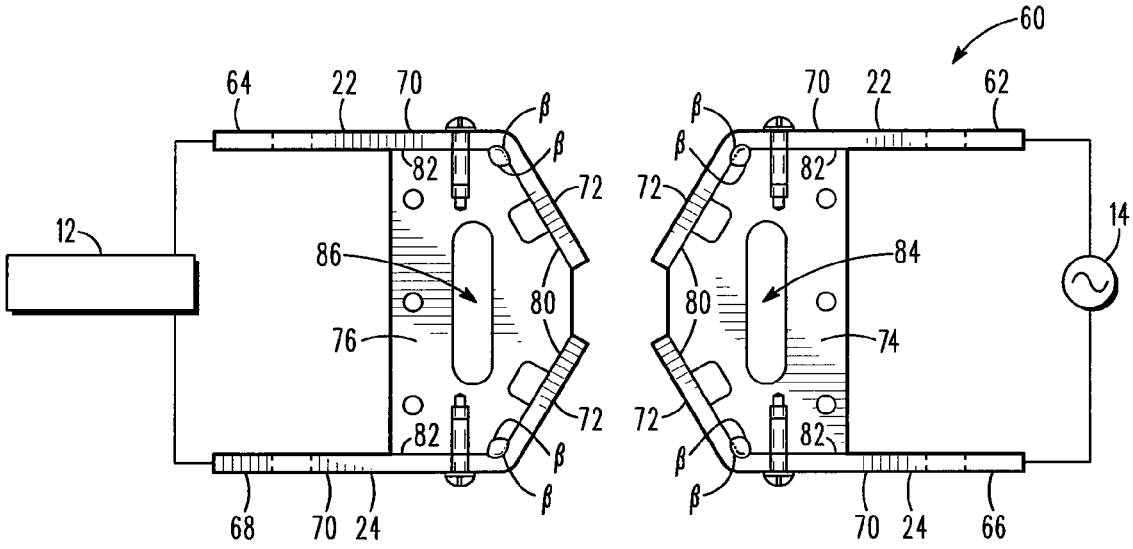
FIG. 5 is a front view of a portion of the switch assembly shown in FIG. 2.

FIG. 5 is a front view of a busbar assembly 60 that is installed in the switch assembly 20 shown in FIGS. 1-4. The busbar assembly 60 includes the first pair of busbars 22 and the second pair of busbars 24. More specifically, the first pair of busbars 22 includes a first busbar 62 and a second busbar 64. The first busbar 62 is configured to be coupled to and receive power from the power source 14. The second busbar 64 is configured to transmit power to the object 12. During operation, the wedge assembly 50, discussed below, is configured to be repositioned to form an electrical connection between the first and second busbars 62 and 64. The second pair of busbars 24 includes a first busbar 66 and a second busbar 68. The first busbar 66 is configured to be coupled to and receive power from the power source 14. The second busbar 68 is configured to transmit power to the object 12. During operation, the wedge assembly 50, discussed below, is configured to be repositioned to form an electrical connection between the first and second busbars 66 and 68.

As shown in FIG. 5, each of the busbars 62, 64, 66, and 68 are substantially similar and include a first portion 70 and a second portion 72. In the exemplary embodiment, the first portion 70 is formed unitarily with the second portion 72 such that each of the busbars 62, 64, 66 and 68 may be formed from a single piece of metallic material. The second portion 72 is formed at an angle $\beta$ with respect to the first portion 70. In one embodiment, the angle $\beta$ is between approximately 145 and 155 degrees. In the exemplary embodiment, the angle $\beta$ is approximately 150 degrees. The busbar assembly 60 further includes a first non-metallic portion 74 that is coupled between the first busbars 62 and 66. The busbar assembly 60 also includes a second non-metallic portion 76 that is coupled between the second busbars 64 and 68. The first and second non-metallic portions 74 and 76 are fabricated from a material that facilitates electrically isolating the pairs of busbars. For example, as discussed above, the busbars 62 and 64 form an electrical circuit and the busbars 66 and 68 form a different electrical circuit. Therefore, first and second non-metallic portion 74 and 76 function as electrical isolators to electrically isolate the two electrical circuits.

As shown in FIG. 5, the first and second non-metallic portion 74 and 76 each have a first side 80 and a second side 82. The first and second sides 80 and 82 of the non-metallic portions 74 and 76 are formed to provide structural support to the busbars 62, 64, 66 and 68. More specifically, the first side 80 is formed at the angle $\beta$ with respect to the second side 82 such that the busbars 62, 64, 66 and 68 are each held firmly in a fixed position with respect to the first and second non-metallic portions 74 and 76, respectively. The first and second non-metallic portion 74 and 76 each also include an opening 84 and 86, respectively, extending therethrough. During operation, airflow emitted from the fan assembly 34 is transmitted through the openings 84 and 86 to facilitate cooling the busbar assembly 60.

Figure 6:
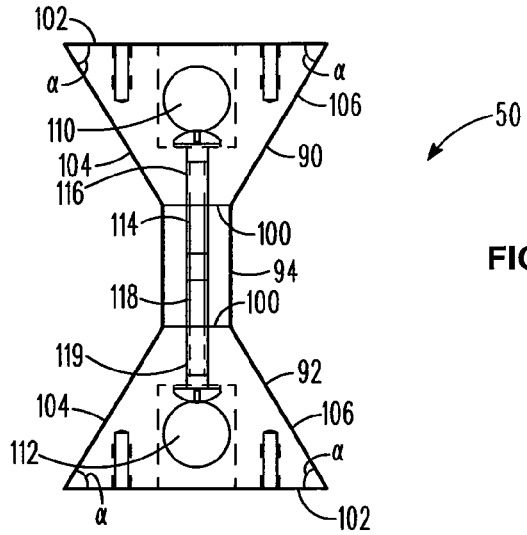
FIG. 6 is a front view of another portion of the switch assembly shown in FIG. 2.

FIG. 6 is a front view of the wedge assembly 50 shown in FIG. 4. In the exemplary embodiment, the wedge assembly 50 is a substantially wedge-shaped device configured to be repositionable to form an electrical circuit between the busbars 62 and 64 and/or the busbars 66 and 68. The wedge assembly 50 includes a first wedge device 90, a second wedge device 92, and an isolating device 94 that is coupled between the first and second wedge devices 90 and 92, respectively. Each wedge device 90 and 92 includes a first end 100, an opposing second end 102, a first side 104, and an opposing second side 106. In the exemplary embodiment, the first end 100 is formed substantially parallel to the second end 102. Moreover, the first side 104 is symmetrical with respect to the second side 106. More specifically, the first side 104 is formed at an angle $\alpha$ with respect to the first end 100 and the second side 106 is also formed at the $\alpha$ angle with respect to the first end 100. In one embodiment, the angle $\alpha$ is between approximately 25 and 35 degrees. In the exemplary embodiment, the angle $\alpha$ is approximately 30 degrees. As a result, each wedge device 90 and 92 is substantially trapezoidal-shaped to enable each wedge device 90 and 92 to be disposed in the opening formed between the pairs of busbars which is discussed in more detail below. The first and second wedge devices 90 and 92 each also include an opening 110 and 112, respectively, extending therethrough. During operation, airflow emitted from the fan assembly 34 is transmitted through the openings 110 and 112 to facilitate cooling the wedge assembly 50.

The wedge assembly 50 also includes the isolating device 94. The isolating device 94 is configured to be positioned between the pair of wedge devices 90 and 92. In the exemplary embodiment, the isolating device 94 is fabricated from a non-metallic material to electrically isolate the wedge device 90 from the wedge device 92. Moreover, the isolating device 94 has a substantially rectangular shape. The isolating device 94 has a first opening 114 that is configured to receive a threaded fastener 116 therein. The isolating device 94 also includes a second opening 118 that is configured to receive a second threaded fastener 119. The threaded fastener 116 is utilized to couple the first wedge device 90 to the isolating device 94. The threaded fastener 119 is utilized to couple the second wedge device 92 to the isolating device 94. The isolating device 94 therefore enables the first wedge device 90 to be coupled to the second wedge device 92 while maintaining an electrical isolation between the first and second wedge devices 90 and 92.

Figure 7:
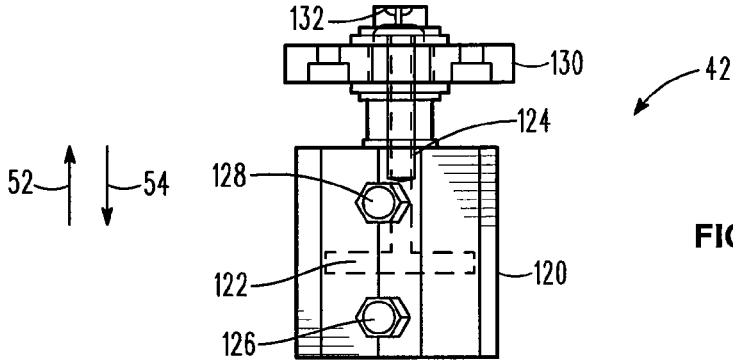
FIG. 7 is a front view of another portion of the switch assembly shown in FIG. 2.

FIG. 7 is a front view of the piston device 42 shown in FIG. 4. The piston device 42 includes a housing 120 and a piston 122 that is disposed within the housing 120. The piston 122 is coupled to, or formed unitarily with, a drive shaft 124. To facilitate receiving an air signal from the solenoid actuator 40, the housing includes a first air input 126 and a second air input 128. During operation, when air is transmitted from the solenoid actuator 40 to the first input 126, via the first air supply tube 44 (shown in FIG. 4), the air causes the piston 122 and thus the shaft 124 to move in the first direction 52. However, when air is transmitted from the solenoid actuator 40 to the second input 128, via the second air supply tube 46 (shown in FIG. 4), the air causes the piston 122 and thus the shaft 124 to move in the second direction 54. In the exemplary embodiment, the piston device 42 is coupled to the wedge assembly 50, such that when air is transmitted from the solenoid actuator 40 to the first input 126 or second input 128, the wedge assembly 50 is also moved in either the first or second direction 52 or 54.

As discussed above, each of the wedge devices 90 and 92 are fabricated from a metallic material to enable the wedge devices 90 and 92 to transmit electrical current across the busbars. Therefore, to isolate the piston device 42 from the wedge device 92, the piston device 42 includes an isolating washer 130. The isolating washer 130 is fabricated from material that is selected to electrically isolate the piston device 42 from the wedge assembly 50. As shown in FIG. 7, the isolating washer 130 is coupled to the shaft 124 via a fastening device 132.

Figure 8:
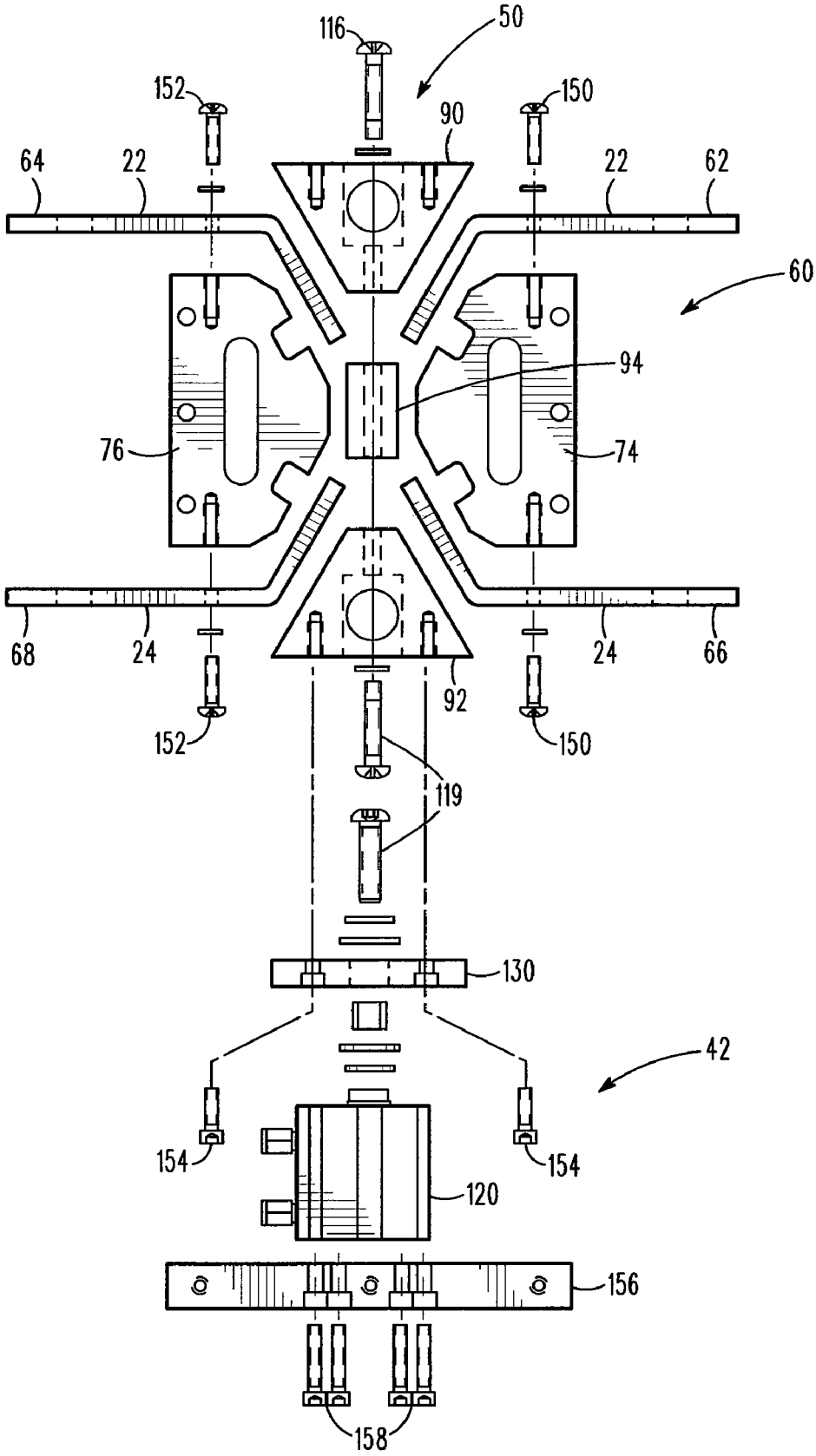
FIG. 8 is an exploded view of a portion of the switch assembly shown in FIG. 2.

FIG. 8 is an exploded view of a portion of the switch assembly 20 shown in FIG. 2. During assembly, the busbar 62 and the busbar 66 are each coupled to the non-metallic portion 74 using a plurality of fasteners 150. Moreover, the busbar 64 and the busbar 68 are each coupled to the non-metallic portion 76 using a plurality of fasteners 152. In the exemplary embodiment, the busbar assembly 60 is stationarily mounted to either the front plate 30 and/or the back plate 32. Moreover, the busbar assembly 60 is electrically isolated from the front and back plates 30 and 32.

The wedge assembly 50 is then assembled and positioned between the busbars 62, 64, 66 and 68. Specifically, each of the wedge devices 90 and 92 are coupled to the isolating device 94 using the fasteners 116 and 119, respectively. The wedge assembly 50 is then positioned between the busbars. More, specifically, the wedge device 90 is positioned between the first pair of busbars 22 such that the wedge device 90, in one mode of operation, forms an electric conducting pathway between the busbar 60 and the busbar 62. Additionally, the wedge device 92 is positioned between the second pair of busbars 24 such that the wedge device 92, in one mode of operation, forms an electric conducting pathway between the busbar 66 and the busbar 68.

The piston device 42 is then coupled to the wedge device 92 using a plurality of fasteners 154. In the exemplary embodiment, the piston device 42 is also coupled to a stationary support member 156 using a plurality of fasteners 158. The support member 156 secures the piston device 42 in a fixed position and thus enables the piston device 42 to reposition the wedge assembly 50 during operation.

Figure 9:
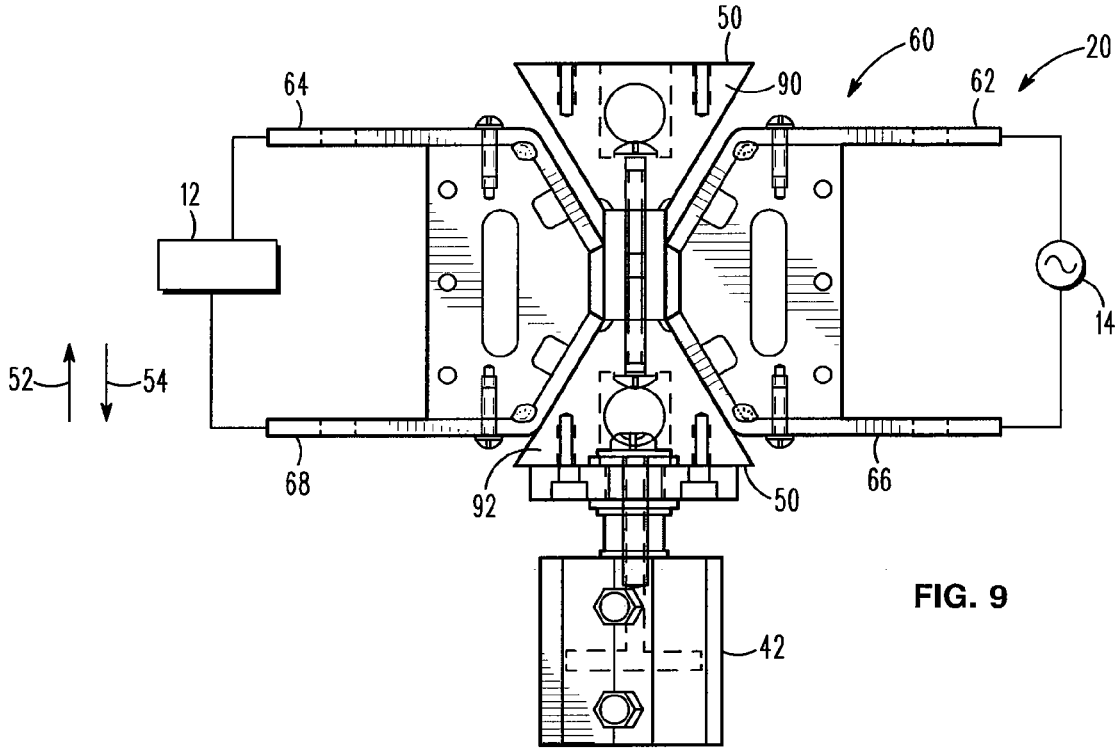
FIG. 9 is a front view of the switch assembly shown in FIG. 2 in a first operational position.
Figure 10:
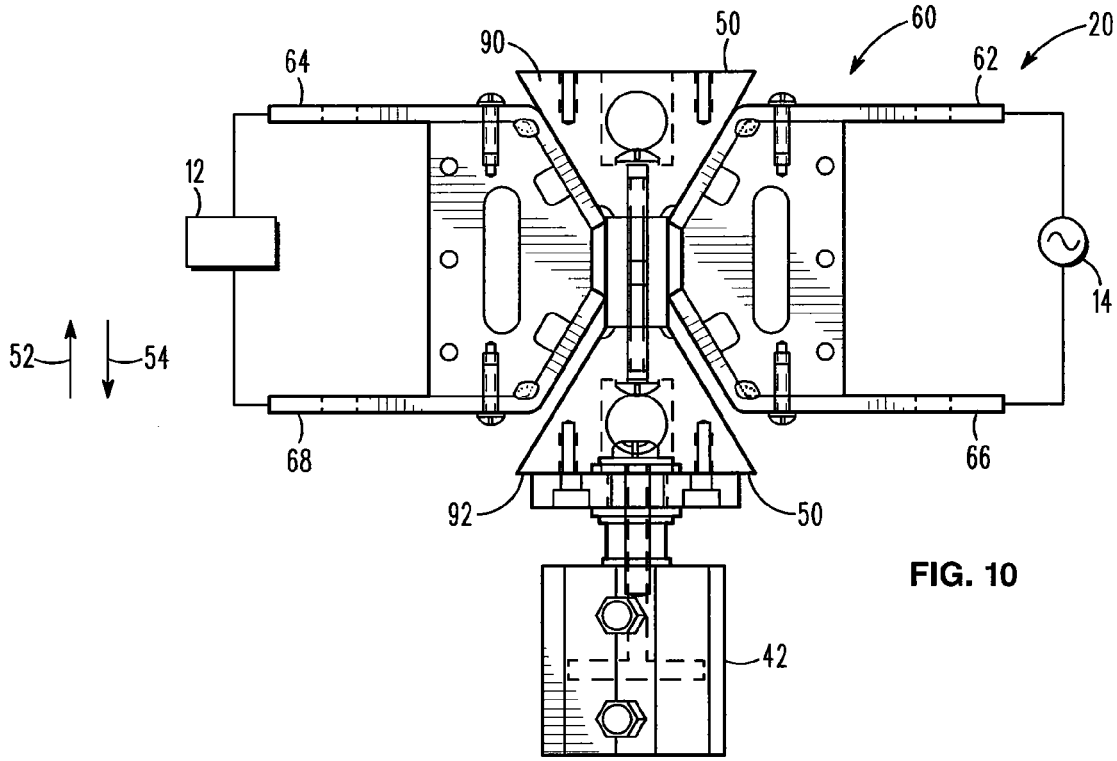
FIG. 10 is a front view of the switch assembly shown in FIG. 2 in a second operational position.

FIG. 9 is a front view of the switch assembly shown in FIG. 2 in a first operational position. FIG. 10 is a front view of the switch assembly shown in FIG. 2 in a second operational position. As discussed above, the switch assembly 20 includes the wedge assembly 50. The wedge assembly 50 includes the pair of wedge-shaped contactors or devices 90 and 92. During operation, the wedge assembly 50 is controlled and repositioned by the electrically actuated pneumatic solenoid 40 and the piston device 42. The wedge assembly 50 is utilized to form an electrical connection between the source 14 and the load or object 12. The shapes of the electrical wedges 90 and 92 are formed to be complementary to the portions 72 of the busbars. During operation, the pneumatic solenoid actuator 40 operating the pneumatic piston device 42 positions the wedge-shaped assembly 50 at one of two positions to change electrical output paths.

For example, in one mode of operation, the solenoid actuator 40 is actuated to transmit an air signal to the piston device 42 via the first air supply tube 44. In this case, the piston device 42 is configured to reposition the wedge assembly 50 in the first direction 52. More specifically, because the wedge assembly 50 is coupled to the piston device 42, actuating the piston device, in this mode of operation, causes the wedge assembly 50 to move in the first direction 52. The wedge assembly 50 is moved until the wedge device 92 is in electrical contact with the busbars 66 and 68 thus forming an electrical circuit between the power source 14 and the object 12.

As shown in FIG. 9, the electrical circuit in this mode of operation includes the power source, the busbar 66, the wedge device 92, the busbar 68, and the object 12. Moreover, in the first mode of operation, the wedge device 90 is electrically isolated from the busbar 62 and the busbar 64.

The optimized wedge shape of the switching wedge devices 90 and 92 provides a greater clamping force over a larger contact area, e.g. the wedge shape provides a larger surface area to form the electrical contact compared to conventional flat bar devices. The wedge engagement also enables self wiping of connection surfaces for improved contact. For example, as the wedge-shaped device 92 makes electrical contact with the busbars 66 and 68, the contact surfaces of the wedge device 92, e.g. the sides 104 and 106, wear into the busbars 66 and 68, respectively, enabling self-maintenance by wearing into each other for extended life. The wedge assembly 50 is self-aligning with respect to the busbar assembly 60 utilizing a floating connection to the pneumatic cylinder rod 124 shown in FIG. 7. More specifically, the floating point connection between the wedge assembly 50 and the piston device 42 enables the wedge assembly 50 to float approximately 360 degrees with respect to the busbar assembly 60. The switch assembly 20 may also be fan cooled to extend the life of the switch assembly 20 and improve the operational efficiency of the switch assembly 20. In the exemplary embodiment, the switch assembly 20 is used in a low voltage, high amperage application, such as shown in FIG. 1. However, it should be realized that switch assembly 20 may also be used for other applications.

In another mode of operation, the solenoid actuator 40 is actuated to transmit an air signal to the piston device 42 via the second air supply tube 46. In this case, the piston device 42 is configured to reposition the wedge assembly 50 in the second direction 54. More specifically, because the wedge assembly 50 is coupled to the piston device 42, actuating the piston device, in this mode of operation, causes the wedge assembly 50 to move in the second direction 54. The wedge assembly 50 is moved until the wedge device 90 is in electrical contact with the busbars 62 and 64 thus forming an electrical circuit between the power source 14 and the object 12. As shown in FIG. 10, the electrical circuit in this mode of operation includes the power source, the busbar 62, the wedge device 90, the busbar 64, and the object 12. Moreover, in the second mode of operation, the wedge device 92 is electrically isolated from the busbar 66 and the busbar 68.

The switching assembly 20 described herein provides various improvements over conventional devices. Conventional devices are typically limited to 5,000 amp operation and include flat bar connections which allow for an inconsistent contact area having a reduced surface area. Conventional devices are subject to overheating which may exceed the material specifications of the device. Specifically, conventional input and output copper busbars have three holes drilled through them to mount a pneumatic cylinder. These holes remove a significant amount of material causing resistance in the circuit. The conventional device may therefore be subjected to overheating during operation, exceeding temperature ratings of materials used. The flat bar design used at the switch connection may not make a good connection consistently. Any variance of the contact surface from contaminants, copper bars not being true, or distortion from the clamping pressure will cause a poor connection.

The exemplary switch assembly 20 described herein has a reduced footprint, is fan cooled, and operates at a higher current capability, with or without the fan operating. The switch assembly 20 has lower circuit resistance, is reverse compatible with known equipment, and provides an improved and simplified electrical busbar/cable connection. Moreover, by using a wedge at the contact area, the switch assembly 20 has a significantly larger surface for the electrical current. The larger surface area increases current rating. The wedge-shaped contactors facilitate reducing and/or eliminating contaminants between the electrical connections connection by wiping across the surface during engagement. The wedge-shaped contactors are also self aligning to the input and output busbars. As the switch assembly 20 is cycled over time, the wedge-shaped contactors wear into the copper input and output busbars extending the life of the connection. The wedge-shaped assembly also allows for movement at the pneumatic cylinder rod connection. By slightly over-sizing the wedge assembly mounting plate insulator hole, a 360 degree adjustment is formed to enable improved contact at the wedge to busbar connection.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

What is claimed is:

1. An electrical switch assembly comprising:

a first pair of busbars, each busbar having a first portion and a second portion, the first portion disposed at an angle with respect to the second portion;

a wedge-shaped assembly configured to be repositionable to form an electrical circuit between the first pair of busbars; and a fan assembly configured to transmit cooling air through the wedge-shaped assembly.

2. An electrical switch assembly in accordance with claim 1 further comprising a second pair of busbars, each of the busbars in the second pair of busbars having a first portion and a second portion, the first portion disposed at an angle with respect to the second portion, the wedge-shaped assembly being repositionable to form an electrical circuit between the second pair of busbars.

3. An electrical switch assembly in accordance with claim 1 further comprising an isolation member coupled between a busbar in the first pair of busbars and a different busbar in a second pair of busbars.

4. An electrical switch assembly in accordance with claim 1 further comprising a solenoid device operably coupled to the wedge-shaped assembly, the solenoid device being configured to reposition the wedge-shaped assembly between either the first pair of busbars or a different second pair of busbars.

5. An electrical switch assembly in accordance with claim 1 further comprising a piston device coupled to the wedge-shaped assembly, the piston device comprising an electrical isolator disposed between the piston device and the wedge-shaped assembly.

6. An electrical switch assembly in accordance with claim 1 wherein the wedge-shaped assembly is configured to reorient a magnetic field from a vertical axis to a horizontal axis.

7. An electrical switch assembly in accordance with claim 1 wherein the first portion is formed at an angle $\alpha$ with respect to the second portion, and a portion of the wedge-shaped assembly is formed at the angle $\alpha$.

8. An electrical switch assembly in accordance with claim 1 wherein the wedge-shaped assembly comprises:

a first wedge-shaped contactor;

a second wedge-shaped contactor; and an insulation device mounted between the first and second wedge-shaped contactors.

9. An electrical switch assembly in accordance with claim 8 wherein the first wedge-shaped contactor forms an electrical circuit between the first pair of busbars and the second wedge-shaped contactor forms an electrical circuit between a different second pair of busbars.

10. An electrical switch assembly comprising:

a first pair of busbars, each busbar in the first pair of busbars having a first portion and a second portion, the first portion disposed at an angle with respect to the second portion;

a second pair of busbars, each busbar in the second pair of busbars having a first portion and a second portion, the first portion disposed at an angle with respect to the second portion;

a wedge-shaped assembly configured to be repositionable between the first and second pairs of busbars, the wedge-shaped assembly comprising a first wedge-shaped contactor to form an electrical circuit between the first pair of busbars and a second wedge-shaped contactor to form an electrical circuit between the second pair of busbars; and a fan assembly configured to transmit cooling air through the wedge-shaped assembly.

11. An electrical switch assembly in accordance with claim 10 an insulation device mounted between the first and second wedge-shaped contactors.

12. An electrical switch assembly in accordance with claim 10 further comprising an isolation member coupled between a busbar in the first pair of busbars and a different busbar in the second pair of busbars.

13. An electrical switch assembly in accordance with claim 10 further comprising a solenoid device operably coupled to the wedge-shaped assembly, the solenoid device being configured to reposition the wedge-shaped assembly between either the first pair of busbars or the second pair of busbars.

14. An electrical switch assembly in accordance with claim 10 further comprising a piston device coupled to the wedge-shaped assembly, the piston device comprising an electrical isolator disposed between the piston device and the wedge-shaped assembly.

15. An electrical switch assembly in accordance with claim 10 wherein the wedge-shaped assembly is configured to reorient a magnetic field from a vertical axis to a horizontal axis.

16. A non-destructive testing system comprising:

a power source; and an electrical switch assembly electrically coupled to the power source; the electrical switch assembly comprising a first pair of busbars, each busbar in the first pair of busbars having a first portion and a second portion, the first portion disposed at an angle with respect to the second portion;

a second pair of busbars, each busbar in the second pair of busbars having a first portion and a second portion, the first portion disposed at an angle with respect to the second portion;

a wedge-shaped assembly configured to be repositionable between the first and second pairs of busbars, the wedge-shaped assembly comprising a first wedge-shaped contactor to form an electrical circuit between the first pair of busbars and a second wedge-shaped contactor to form an electrical circuit between the second pair of busbars; and a fan assembly configured to transmit cooling air through the wedge-shaped assembly.

17. A non-destructive testing system in accordance with claim 16 wherein the electrical switch assembly further comprises an insulation device mounted between the first and second wedge-shaped contactors.

18. A non-destructive testing system in accordance with claim 16 wherein the electrical switch assembly further comprises an isolation member coupled between a busbar in the first pair of busbars and a different busbar in the second pair of busbars.

19. A non-destructive testing system in accordance with claim 16 wherein the electrical switch assembly further comprises:

a solenoid device operably coupled to the wedge-shaped assembly, the solenoid device being configured to reposition the wedge-shaped assembly between either the first pair of busbars or the second pair of busbars; and a piston device coupled to the wedge-shaped assembly, the piston device comprising an electrical isolator disposed between the piston device and the wedge-shaped assembly.

* * * * *